US006129569A

United States Patent [19]

Fernandez

[11] Patent Number: 6,129,569

[45] Date of Patent: Oct. 10, 2000

[54] ELECTROSTATIC DISCHARGE PROTECTION DEVICE FOR COAXIAL SYSTEMS

[75] Inventor: Luis Fernandez, Santa Rosa, Calif.

[73] Assignee: Agilent Technologies Inc., Palo Alto, Calif.

[21] Appl. No.: 09/334,479

[22] Filed: Jun. 16, 1999

[51] Int. Cl.[7] ..... H01R 13/53

[52] U.S. Cl. ..... 439/181

[58] Field of Search ..... 439/181, 138, 439/578

[56] References Cited

U.S. PATENT DOCUMENTS 5,381,134 1/1995 Friday et al. ..... 439/138

*Primary Examiner*—Lincoln Donovan
*Assistant Examiner*—Javaid Nasri
*Attorney, Agent, or Firm*—John L. Imperato

[57] ABSTRACT

An electrostatic discharge (ESD) protection device for coaxial systems ensures that center conductors of coaxial cables are discharged prior to insertion of the cables into a coaxial connector of an electronic instrument. The device includes a conductive mounting post fastened to the instrument and conductive hinge, pivotally mounted to an end of the post. The conductive hinge has a raised target area for contacting the center conductor of a conductive cable. Prior to insertion of the cable into the coaxial connector, the conductive hinge rests in a neutral position, obstructing access of the cable to the coaxial connector. When the cable is advanced toward the coaxial connector of an electronic instrument, the center conductor of the cable contacts the target area, thereby grounding the center conductor to the instrument through the conductive hinge and conductive mounting post. When the cable is further advanced toward the coaxial connector, the conductive hinge pivots to a second resting position in which the coaxial connector is accessible to the cable.

9 Claims, 2 Drawing Sheets

ELECTROSTATIC DISCHARGE PROTECTION DEVICE FOR COAXIAL SYSTEMS

BACKGROUND OF THE INVENTION

Semiconductor devices within many electronic instruments have small device geometries, making the devices susceptible to damage from electrostatic discharge (ESD). ESD can cause catastrophic failure of an instrument, latent failures that lower the reliability of an instrument or other types of failures in which instrument performance is degraded. Semiconductor devices in the front-end circuitry of oscilloscopes, spectrum analyzers and other instruments are especially susceptible to ESD damage from electrostatic charges on the cables that are inserted into coaxial connectors at the instruments' input ports.

The incidence of ESD damage can be reduced by discharging each cable before insertion of the cable into the instrument's coaxial connector. Typically, a user of an instrument discharges a cable by momentarily grounding the cable's center conductor to the chassis of the instrument. Since ESD damage can result whenever the grounding of the center conductor is omitted, each user of an electronic instrument must remember to manually discharge each cable prior to inserting the cable into the instrument's coaxial connector. The presence of failures of electronic instruments that are attributable to ESD indicates that relying on a user's mindfulness to discharge cables is not entirely effective in reducing incidence of ESD damage.

SUMMARY OF THE INVENTION

According to the preferred embodiment of the present invention a device provides electrostatic discharge (ESD) protection for coaxial systems. The device ensures that the center conductors of coaxial cables are discharged prior to insertion of the cables into coaxial connectors of electronic instruments. The electrostatic discharge protection device includes a conductive mounting post fastened to the electronic instrument upon which a coaxial connector is also mounted. A conductive hinge, pivotally mounted to an end of the conductive mounting post, has a raised target area for contacting the center conductor of a coaxial cable. Before a cable is inserted into the coaxial connector, the conductive hinge rests in a neutral position, obstructing access of the cable to the coaxial connector. When the cable is advanced toward the instrument's coaxial-connector, the center conductor of the cable contacts the target area, thereby grounding the center conductor to the instrument chassis and discharging the cable. As the cable is further advanced toward the coaxial connector, the conductive hinge pivots to a second resting position in which the coaxial connector is accessible to the cable.

DETAILED DESCRIPTION OF THE PREFERRED EMBODIMENT

Figure 2A:
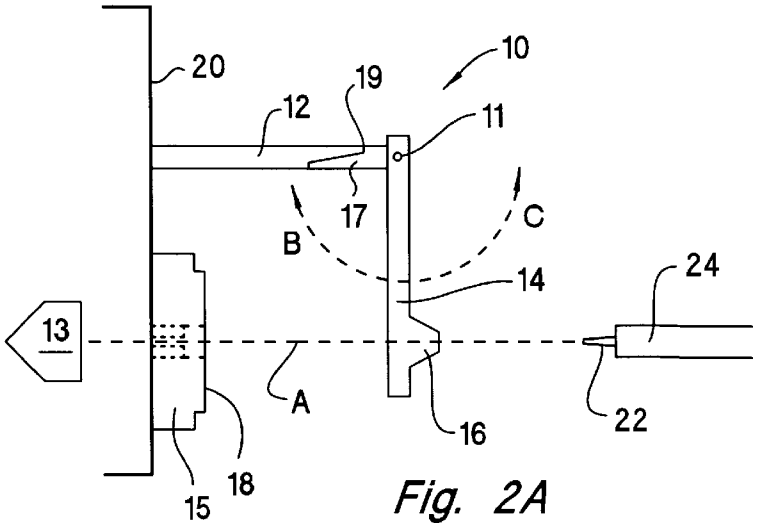
FIGS. 2A–B and 3A–B show side views of the electrostatic discharge (ESD) protection device constructed according to the preferred embodiment of the present invention.

FIGS. 1, 2A–B and 3A–B show an electrostatic discharge (ESD) protection device 10 constructed according to the preferred embodiment of the present invention. The device 10, including a conductive mounting post 12, pivot 11 and conductive hinge 14, is integrated onto the chassis of an electronic instrument 20 and provides protection to semiconductor devices 13 and other sensitive components within the instrument 20 against damage from ESD. The conductive mounting post 12 is electrically coupled to the electronic instrument 20 by screwing, press fitting, or otherwise fastening the post 12 to the instrument 20. The conductive hinge 14 has a raised target area 16 for contacting a center conductor 22 of coaxial cable 24 prior to insertion of the cable into a coaxial connector 18. A conductive path is provided between the target area 16 and the outer conductor 15 of the coaxial connector 18. The target area 16 is electrically coupled to the chassis of the instrument 20 through the conductive hinge 14, the pivot 11 and the conductive post 12. The outer conductor 15 is also electrically coupled to the chassis of the instrument 20, by mounting the coaxial connector 18 on the chassis of the instrument 20.

Figure 2B:
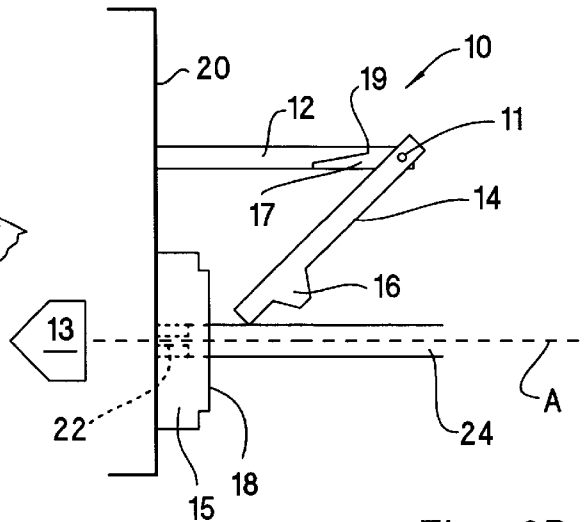
Figure 1:
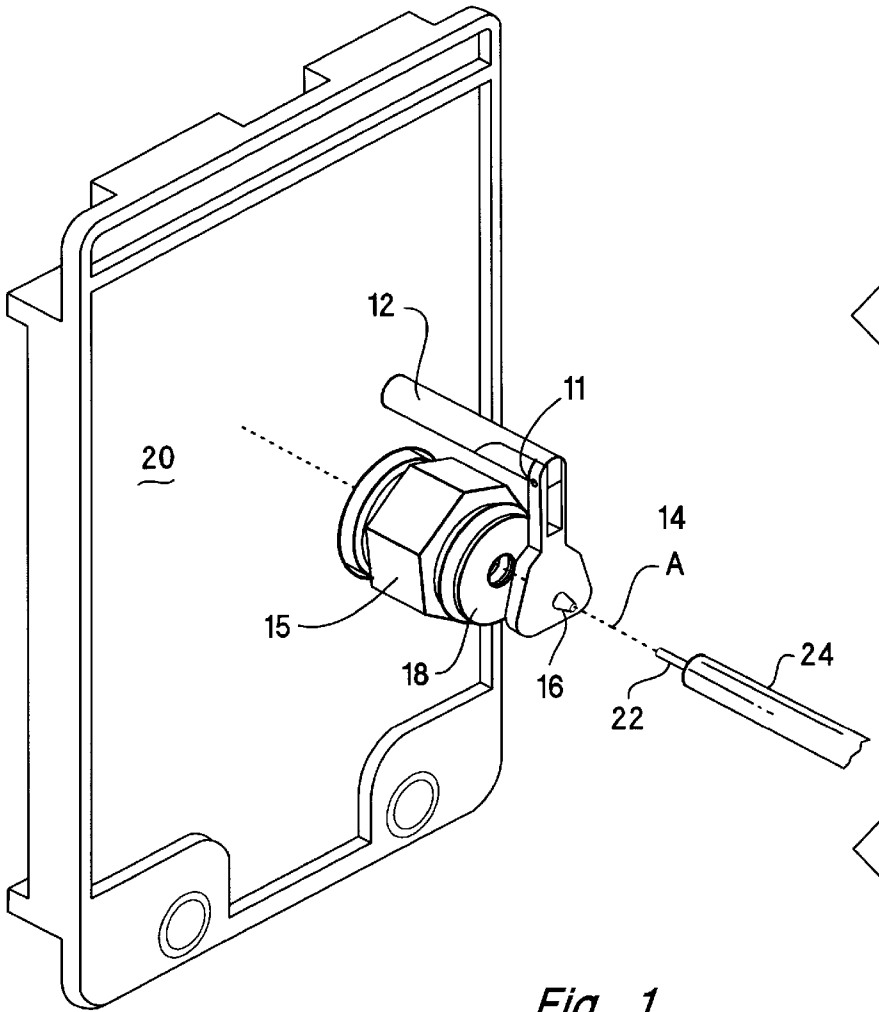
FIG. 1 shows a perspective view of an electrostatic discharge (ESD) protection device constructed according to the preferred embodiment of the present invention.

As shown in FIG. 2A, before the coaxial cable 24 is inserted into the coaxial connector 18, the conductive hinge 14 rests in a neutral position, obstructing access of the cable 24 to the coaxial connector 18. When a user of the electronic instrument 20 advances the cable 24 toward the coaxial connector 18 along a central axis A of the connector 18, the center conductor 22 of the cable 24 contacts the target area 16, thereby grounding the center conductor 22 to the instrument chassis 20 through the ESD protection device 10. When the user further advances the cable 24 toward the coaxial connector 18, the conductive hinge 14 pivots to a second resting position, as shown in FIG. 2B, in which the cable 24 is accessible to the coaxial connector 18. In this example, the conductive hinge 14 pivots along arc B when traversing between the neutral position and the second resting position, pivoting less than ninety degrees. The conductive post 12 is made long enough so that the conductive hinge 14 sufficiently clears the connector 18 when the cable 24 is inserted into the connector 18. A fillet 17 and stop 19 are optionally included to prevent pivoting of the conductive hinge 14 along arc C while enabling the conductive hinge 14 to pivot along arc B.

Figure 3A:
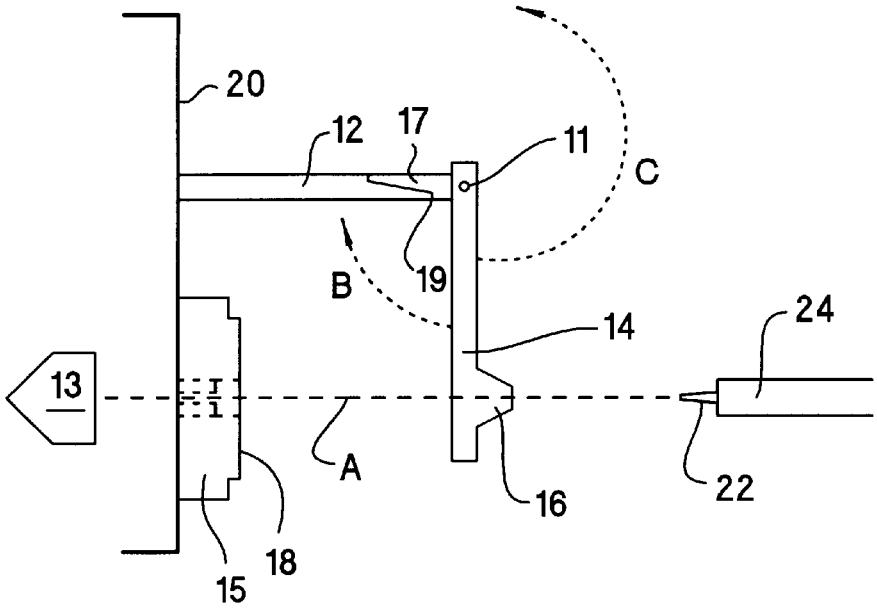
Figure 3B:
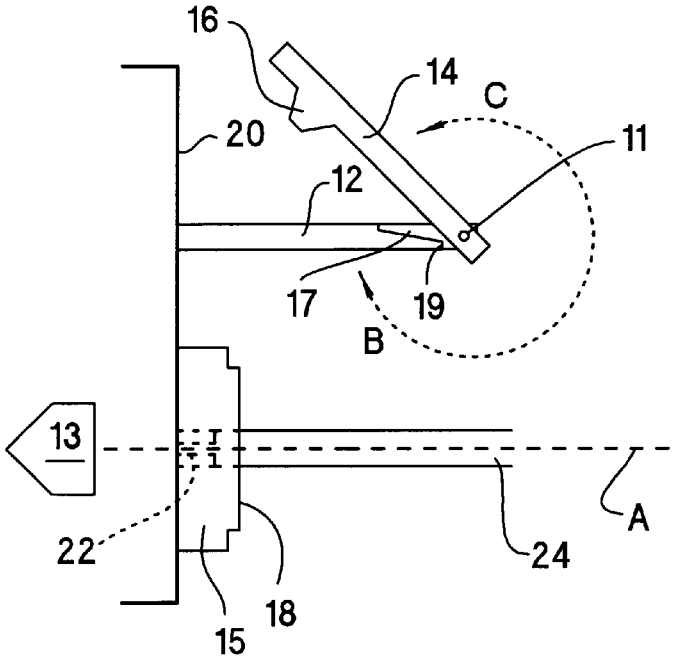

As shown in FIGS. 3A–B, the ESD protection device 10 is alternatively adapted so that the conductive hinge 14 pivots along arc C. In this alternative adaptation, the cable 24 is advanced toward the coaxial connector 18 along the central axis A of the connector 18 so that the center conductor 22 of the cable 24 contacts the target area 16 and is thereby grounded to the instrument chassis 20. However, before further advancing the cable 24 along central axis A, the conductive hinge 14 is manually pivoted along arc C to a second resting position (shown in FIG. 3B) so that the hinge 14 no longer obstructs access of the cable 24 to the coaxial connector 18. In traversing between the neutral position and the second resting position, the conductive hinge 14 pivots more than one hundred and eighty degrees along arc C. With the conductive hinge 14 in the second resting position as shown in FIG. 3B, the coaxial cable 24 can then be advanced along central axis A and inserted into the coaxial connector 18. Fillet 17 and stop 19 are optionally included to prevent pivoting of the conductive hinge 14 along arc B while enabling the conductive hinge 14 to pivot along arc C.

The ESD protection device 10 as shown in FIGS. 1, 2A–B and 3A–B provides for grounding of the center conductor 22 of a coaxial cable to the electronic instrument 20 prior to insertion of the cable 24 into the coaxial connector 18. The cable 24 is discharged as a result of the contact between the target area 16 and the center conductor 22.

While the preferred embodiment of the present invention has been illustrated in detail, it should be apparent that modifications and adaptations to the embodiment may occur to one skilled in the art without departing from the scope of the present invention as set forth in the following claims.

What is claimed is:

1. A device for grounding a center conductor of a coaxial cable to an instrument having a coaxial connector, comprising:

a conductive mounting post at a first end grounded to the instrument; and a conductive hinge pivotally mounted to a second end of the conductive mounting post, the conductive hinge having a raised target area for contacting the center conductor of the conductive cable, the conductive hinge having a first resting position obstructing access of the coaxial cable to the coaxial connector and in a second resting position the conductive hinge being non-obstructive to the coaxial connector, making the coaxial connector accessible to the coaxial cable.

2. The device of claim 1 wherein the conductive mounting post is parallel to a central axis of the coaxial connector.

3. The device of claim 2 wherein the conductive hinge includes a planar surface that is orthogonal to the mounting post when the conductive hinge is in the first position.

4. The device of claim 3 wherein the raised target area is aligned with the central axis of the coaxial connector.

5. The device of claim 4 wherein advancement of the coaxial cable toward the coaxial connector beyond the planar surface of the conductive hinge pivots the conductive hinge to the second position when the coaxial cable engages the coaxial connector.

6. The device of claim 5 wherein the conductive hinge traverses less than ninety degrees when pivoting between the first position and the second position.

7. The device of claim 6 wherein the conductive post further includes a fillet and a stop, the fillet enabling the conductive hinge to pivot between the first position and the second position and between the second position and the first position, the stop preventing the conductive hinge from pivoting other than between the first position and the second position and between the second position and the first position.

8. The device of claim 4 wherein the conductive hinge traverses more than one hundred and eighty degrees when pivoting between the first position and the second position.

9. The device of claim 8 wherein the conductive post further includes a fillet and a stop, the fillet enabling the conductive hinge to pivot between the first position and the second position and between the second position and the first position, the stop preventing the conductive hinge from pivoting other than between the first position and the second position and between the second position and the first position.

* * * * *